US008156755B2

(12) United States Patent
Murray et al.

(10) Patent No.: US 8,156,755 B2
(45) Date of Patent: Apr. 17, 2012

(54) REFRIGERATOR FOR STORING VIALS AND CARTRIDGE FOR USE IN THE SAME

(75) Inventors: Stephen Murray, Oosterbeek (NL); Gaynor Hillier, Boxworth Cambs (GB); Philip Nigel Bordet-Stead, London (GB); Tanja Langgner, London (GB); David Helps, London (GB)

(73) Assignee: Intervet International B.V., Boxmeer (NL)

( * ) Notice: Subject to any disclaimer, the term of this patent is extended or adjusted under 35 U.S.C. 154(b) by 409 days.

(21) Appl. No.: 11/144,955

(22) Filed: Jun. 3, 2005

(65) Prior Publication Data

US 2006/0272351 A1 Dec. 7, 2006

(51) Int. Cl.
*F25D 25/00* (2006.01)

(52) U.S. Cl. ..... 62/378; 62/377; 62/457.9; 62/465; 221/91; 221/134; 221/197

(58) Field of Classification Search ..... 62/465, 62/377, 378, 459.7; 221/134, 197, 91
See application file for complete search history.

(56) References Cited

U.S. PATENT DOCUMENTS

| | | | | | |
|---|---|---|---|---|---|
| 86,277 | A | * | 1/1869 | Brewster | 312/61 |
| 1,021,670 | A | * | 3/1912 | Garey | 220/592.16 |
| 1,633,588 | A | * | 6/1927 | Klinenberg | 221/131 |
| 1,695,956 | A | * | 12/1928 | Frick | 221/97 |
| 2,695,729 | A | * | 11/1954 | Hornish | 221/79 |
| 2,826,471 | A | | 3/1958 | Fonda | |
| 3,184,104 | A | * | 5/1965 | De Domenico et al. | 221/92 |
| 3,390,754 | A | * | 7/1968 | Newberry | 194/240 |
| 4,019,339 | A | * | 4/1977 | Anderson | 62/255 |
| 4,194,647 | A | * | 3/1980 | Spurrier | 221/97 |
| 4,391,388 | A | * | 7/1983 | Krakauer | 221/76 |
| 4,869,395 | A | * | 9/1989 | Rubbmark | 221/131 |
| 5,142,872 | A | | 9/1992 | Tipton | |
| 5,368,194 | A | * | 11/1994 | Oliff et al. | 221/305 |
| 5,706,977 | A | * | 1/1998 | Ogura et al. | 221/197 |
| 6,164,490 | A | * | 12/2000 | Bishop et al. | 221/197 |
| 6,330,958 | B1 | * | 12/2001 | Ruskin et al. | 221/75 |
| 7,334,701 | B2 | * | 2/2008 | Chirnomas et al. | 221/197 |
| 2001/0039802 | A1 | * | 11/2001 | Barrash | 62/6 |
| 2004/0069795 | A1 | * | 4/2004 | Sams | 221/281 |

FOREIGN PATENT DOCUMENTS

| | | | |
|---|---|---|---|
| JP | 01250195 | A * | 10/1989 |
| WO | 8707704 | | 12/1987 |
| WO | 02053085 | A2 | 7/2002 |

* cited by examiner

*Primary Examiner* — Frantz Jules
*Assistant Examiner* — Azim Rahim
(74) *Attorney, Agent, or Firm* — William M. Blackstone

(57) ABSTRACT

The invention relates to a refrigerator for storing vials containing a (bio)pharmaceutical substance, in particular vaccines for animals, comprising a cabinet having an internal space for accommodating the vials arranged in columns, a cooling element for cooling the internal space and at least one door or dispenser for removing vials from the internal space. A plurality of guides located inside the space and adapted to slidingly accommodate columns of the vials. The invention further relates to a cartridge suitable for use in the said refrigerator.

9 Claims, 1 Drawing Sheet

REFRIGERATOR FOR STORING VIALS AND CARTRIDGE FOR USE IN THE SAME

FIELD OF THE INVENTION

The invention relates to a refrigerator for storing vials containing a (bio)pharmaceutical substance, in particular vaccines for animals, comprising a cabinet having an internal space for accommodating the vials arranged in columns, a cooling element for cooling the internal space and at least one door or dispenser for removing vials from the internal space. The invention also relates to a cartridge suitable for use in such a refrigerator.

BACKGROUND OF THE INVENTION

Refrigerators for storing vials are known. German utility model DE 20007889 U1 relates to an insulated case (denoted by numeral 1 in the Figures) for medication, having a thermal insulation layer (2), holders for ampoules, a heat deflection plate (4) linked to a Peltier module (5), and a fan. An electronic control block (6) has a voltage control, an operating voltage control system, an overheating protection system and a thermostat. The control block (6) controls the Peltier module (5) and the fan. Further, the front wall of the case serves as a door.

WO 87/07704 relates to a refrigerant cell designed to receive insulin ampoules. Its size is such that it can accommodate ampoules of all European manufactures. The refrigerant cell is suitable for a refrigeration unit designed for mains and battery use.

DK 468 380 relates to a device for a refrigerator driven by a compressor with a cold accumulator placed against the side walls in the storing compartment of the refrigerator in order to enable the use of the refrigerator with maintained storing temperature even under long-term conditions of disruption of the power supply to the compressor. The cold accumulator consists of a number of vertical tubes 17 standing tightly against each other and containing a fluid having a freezing point around 0 degrees centigrade. The tubes 17 are brought into place by means of a top frame 18 resting on a flat 19 in the upper edge of the refrigerator and having a chute for the tubes.

SUMMARY OF THE INVENTION

It is an object of the present invention to provide an improved refrigerator for storing vials containing a (bio)pharmaceutical substance.

To this end, the refrigerator according to the present invention comprises guides located inside the space and adapted to slidingly accommodate columns of the vials.

It is preferred that each of the guides or each set of guides comprises a dispensing section where the vials can be readily removed from the guides, preferably on one end of the respective guide or set of guides.

The guides facilitate a more systematic, safe and/or hygienic use of the refrigerator and, as will explained below, enable the use of one or more relatively small entrances e.g. one or more relatively small doors or dispensers, such as a one or more drawers or air locks.

It is preferred that the columns extend in a direction having a vertical component, i.e. not horizontally, and/or that at least some of the guides are associated with a means, such as a spring, for biasing the vials towards the dispensing section. In such embodiments, gravity and/or a spring or the like can be employed to urge the vials towards e.g. a dispensing section at one end of the guides, thus holding the vial(s) at the said dispensing section in place and pushing remaining vials towards the dispensing section when a vial in that section is removed.

If the door(s) respectively the dispenser(s) is (are) located at the dispensing section of one or more columns and allows access to a limited number of vials or even a single vial, fluctuations of temperature inside the internal space are effectively reduced.

It is further preferred that the cabinet comprises at least two mutually detachable housings, a first housing containing the vials, and a second housing comprising the cooling element. Thus, the first housing is portable and can be taken along by e.g. a doctor or veterinarian. Especially if the first housing will be transported over relatively large distances or otherwise be separated from the second housing for prolonged periods of time, it is preferred that the means of transport of the said person(s), typically a car or van, or, for instance, a second surgery or annex, is equipped with an auxiliary second housing comprising a cooling element.

The invention also relates to a cartridge for use in a refrigerator described above, comprising guides adapted to slidingly accommodate a plurality of vials. Such cartridges can be employed as a means for packaging a plurality of vials and facilitate distribution of the vials and refilling of the cabinet.

Within the framework of the present invention, the word 'cartridge' includes cassettes, clips, and indeed any entity suitable for slidingly holding a column of vials.

The invention will now be explained in more detail with reference to the drawings, which schematically show a presently preferred embodiment.

It is noted that the drawings are not necessarily to scale and that details, which are not required for understanding the present invention, may have been omitted. The terms "upper", "lower", "vertical", "horizontal", "front", "rear", "side", and the like relate to the embodiments as oriented in the figures. Further, elements that are at least substantially identical or that perform an at least substantially identical function are denoted by the same numeral.

DETAILED DESCRIPTION OF THE INVENTION

Figure 1:
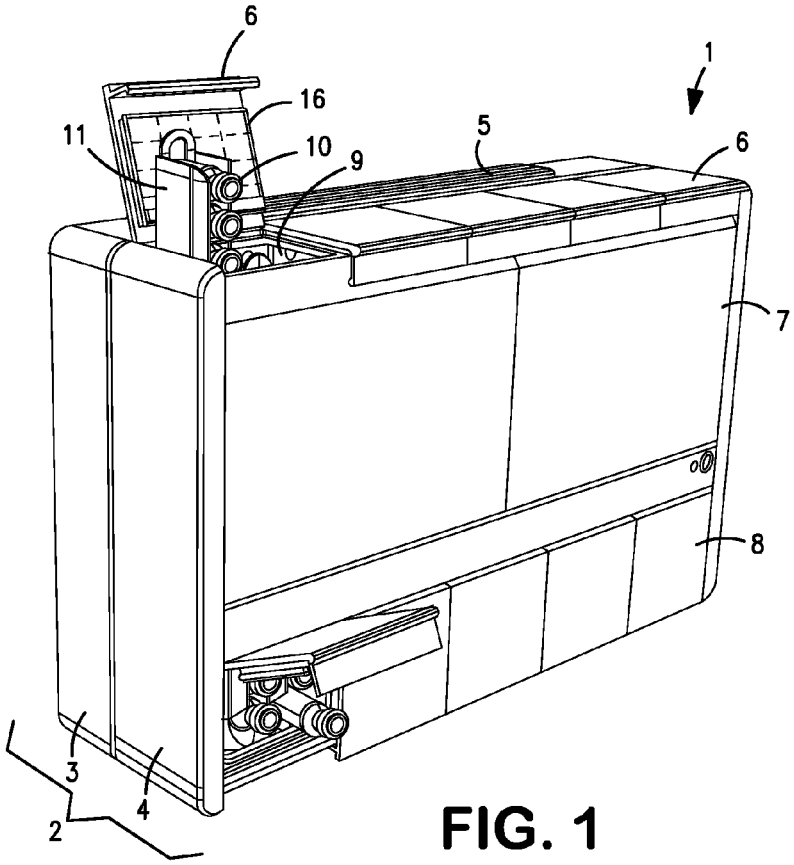
FIG. 1 is a perspective view of the refrigerator according to the present invention, with a top door and a bottom door opened.

FIG. 1 shows a refrigerator 1 according to the present invention for storing vials containing a pharmaceutical or biopharmaceutical substance, in particular vaccines for animals. The refrigerator 1 comprises a cabinet 2 having a rear housing 3 to be mounted on a wall or inside a vehicle and a front housing 4 detachably mounted, e.g. by means of hooks and slots, magnets or Velcro, on the front side of the rear housing 3.

The rear housing 3 contains a cooling element (not shown), preferably a Peltier element sandwiched between two thermally conductive plates, e.g. two aluminium plates, the front one of which extends over a substantial section of the front wall of the rear housing 3. Ventilation grids 5 are included in the bottom and top surfaces. Further, the rear housing 3 comprises a ventilator for cooling the hot side of the cooling element, a control unit connected to the cooling element and the ventilator, as well as to a connector provided in the front wall of the rear housing 3, and a battery pack or a transformer to be connected to the mains or a battery of a vehicle.

The front housing 4 corresponds in width and height to the rear housing 3 and comprises three sets of doors 6, 7, 8, all providing access to an internal space 9 accommodating a large number of vials 10 arranged in substantially vertical columns along guides, as will be explained below. The lowermost doors 8 extend substantially vertically and the upper rim of each of these doors 6 is pivotally connected to the front housing 4. By pivoting one of these doors 8 forwards and upwards, the lowermost vials 10 in a group of e.g. three adjacent columns is exposed, thus allowing removal of the vials 10 from the respective columns.

The uppermost doors 6 extend substantially horizontally and are pivotally mounted in the upper wall of the front housing 4. By pivoting one of these doors 6 upwards and backwards, again a group of e.g. three adjacent columns of vials 10 is exposed.

When the front housing 4 is mounted on the rear housing 3, the rear wall of the front housing 4 abuts the Peltier element.

Although permanent guides, such as vertical ducts or partition walls, extending along the columns inside the internal space 9 will provide an effective means for slidingly accommodating the vials 10, it is preferred that elongated cartridges 11 are removably mounted side-by-side in the space 9.

Figure 2A:
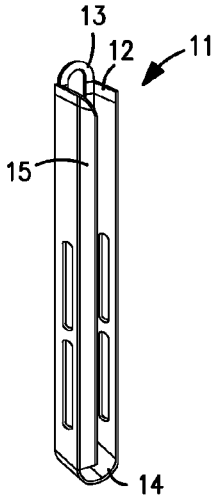
FIGS. 2A and 2B are perspective views of respectively an empty and a filled cartridge suitable for use in a refrigerator.
Figure 2B:
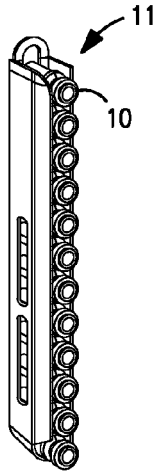

An example of a preferred cartridge 11, intended for use in the present refrigerator 1, is shown in FIGS. 2A and 2B. This preferred cartridge 11 comprises two parallel side walls 12 connected by a rear wall 13 and a bottom wall 14. The side walls 12 are separated by a distance that is slightly larger than the width of the vials 10. In this preferred embodiment, the bottom wall 14 has been adapted to the shape of the vials 10, i.e. has a semi-circular cross-section. Two retaining strips 15, inclined towards the plane of symmetry of the cartridge 11, extend along almost the entire length of the side walls 12, i.e. to a distance above the bottom wall 14 that corresponds to the width of the vials 10. Together with the side walls 12, the retaining strips 15 form effective guides for slidingly holding a column of vials 10 and define a dispensing position at the bottom end of the cartridge 11, i.e. the lowermost vial 10 can be pulled out of the cartridge 11 in a direction substantially perpendicular to the column of remaining vials.

Although the dispensing position can in principle also be employed to fill the cartridge 11 with vials, it is preferred that the cartridge 11 further comprise a filling section, preferably on the other end of the cartridge 11 as shown in FIGS. 2A and 2B. I.e., the cartridge 11 can be filled by entering vials into a top opening of the cartridge 11 with the necks of the vials 10 sliding in between the retaining strips 15.

In the embodiment shown in the Figures, the front wall of the front housing 4 further comprises one or more e.g. two relatively large doors 7 providing access to the internal space 9 for maintenance or cleaning. Alternatively, the front wall is fixedly attached to or forms an integral whole with the front housing 4.

The front wall further comprises a switch to turn the Peltier element on or off and a warning light to indicate that a selected threshold value, stored in the control unit, for minimum temperature has been reached. Alternatively or additionally, the cabinet can be provided with e.g. a regulator for setting the required temperature, a small display showing the set and/or actual temperature (measured e.g. by means of thermocouples located in the internal space), and/or a speaker for sounding an alarm when the selected threshold has been reached. The rear wall of the front housing is provided with a connector-counterpart, which is detachably connected to the connector on the front wall of the rear housing and which thus connects the said switch, warning light, regulator, display and other elements for operating the refrigerator to the control unit.

The walls of the rear and front sections are preferably made of an injection moulded thermoplastic polymer, such as ABS, PC or a fibre-filled PP. The walls of at least the front housing are thermally insulated by means of e.g. a layer of an expanded polyurethane or polyester foam and, optionally, a reflective film of aluminium, sandwiched between inner and outer walls of the said injection moulded thermoplastic polymer. Insulated sections on the doors are preferably surrounded by seals (16), such as rubber rings.

Further, it is preferred that part of the front wall, e.g. the lower sections of the relatively large doors 7, are made of a transparent material, such as a clear double-skinned PS or PC, so as to allow personnel using the cabinet to see which vials, and hence which pharmaceutical substance, is in which row.

The cartridges are also preferably made of an injection moulded thermoplastic polymer, in particular a clear PC.

During use, the refrigerator is mounted on e.g. a wall of a surgery of a veterinarian, the Peltier element is switched on and, when a sufficiently low temperature has been reached, the top doors are opened and cartridges, each containing a plurality of vials, are loaded into the internal space. The vials in each cartridges or group of cartridges contain a different vaccine and include, for instance, cartridges containing freeze-dried pellets (lyophilisates or "cakes") of PPi, Parvo-C, Corona, KC, DHPPI, and Puppy DP (as denoted in the Intervet product catalogue 2005). When a specific vaccine is to be administered, the corresponding lower door is opened and a vial is taken from the appropriate column and a diluent, typically water, a water-in-oil emulsion or an oil-in-water emulsion is injected into the vial to obtain an injectable substance.

From the above description, it will be clear that the refrigerator according to the present invention facilitates or even imposes a more systematic, safe and/or hygienic use and that only a limited amount of the cooled air inside the refrigerator will escape during the removal of a vial, substantially avoiding a significant reduction of the temperature inside.

Although the cartridges can be filled with individual vials by personnel using the present refrigerator, e.g. by a veterinary or an assistant, it is preferred to distribute, through existing channels, pre-filled cartridges or even pre-filled (front) housings containing columns of vials.

The invention is not restricted to the above-described embodiments, which can be varied in a number of ways within the scope of the claims. For instance, the cabinet preferably comprises an additional compartment for storing pre-filled syringes or a diluent. To prevent the injectable substance from being too cold, it is preferred that the cooling (Peltier) element does not extend over the compartment for storing the diluent or that this compartment is isolated from the cooling element.

What is claimed is:

1. A method for transporting, storing and selectively dispensing vials containing (bio)pharmaceutical compositions, comprising:

providing two or more vials containing (bio)pharmaceutical compositions;

providing at least two removable cartridges for holding the two or more vials;

placing the vials into the removable cartridges, wherein all vials placed into each removable cartridge contain the same (bio)pharmaceutical composition;

providing a first housing having an internal space for accommodating the at removable cartridges and a door or dispenser through which a selected vial may be removed from one of the removable cartridges to the exterior of the first housing;

placing the removable cartridges containing the vials into the first housing;

providing a second housing comprising a cooling element;

transporting the first housing to the second housing;

detachably mounting the first housing onto the exterior of the second housing, such that the first housing and the second housing share a single common interface and the first housing and the second housing are mutually detachable, whereby the first housing and the second housing may be detached or attached without requiring the use of tools and without disturbing the contents of either, the first housing being portable and the second housing having capacity for the attachment of only one first housing at a time, and the first housing and the second housing being members of a multiplicity of first housings and second housings that may be interchangeably attached;

cooling the internal space of the first housing with the cooling element of the second housing, and thereby cooling the removable cartridges and the vials that had been placed therein; and selectively dispensing a vial containing a desired (bio) pharmaceutical composition through the door or dispenser.

2. The method according to claim 1, wherein the first housing securely retains the removable cartridges for transporting the vials contained therein.

3. The method according to claim 1, wherein the front wall of the first housing is at least partially transparent.

4. The method according to claim 1, wherein each removable cartridge comprises guides adapted to slidingly accommodate each vial.

5. The method according to claim 4, wherein each removable cartridge comprises two parallel side walls connected by a rear wall and separated by a distance that is slightly larger than the width of each vial for which the cartridge is intended.

6. The method according to claim 5, wherein the two sidewalls comprise two lips, inclined towards the centre of the cartridge and extending along most of the length of the side walls.

7. The method according to claim 1, wherein the second housing is wall mounted.

8. The method according to claim 1, wherein the second housing is mounted in a means of transport.

9. The method according to claim 1, wherein the first housing comprises a control that can turn on and turn off the cooling element in the second housing.

* * * * *

UNITED STATES PATENT AND TRADEMARK OFFICE

CERTIFICATE OF CORRECTION

PATENT NO. : 8,156,755 B2
APPLICATION NO. : 11/144955
DATED : April 17, 2012
INVENTOR(S) : Stephen Murray et al.

It is certified that error appears in the above-identified patent and that said Letters Patent is hereby corrected as shown below:

Claim 1, Column 4, Line 67: Please delete "at" after the.

Signed and Sealed this
Fifth Day of June, 2012

David J. Kappos

David J. Kappos
*Director of the United States Patent and Trademark Office*